US012329266B1

(12) United States Patent
Butler-Smith

(10) Patent No.: US 12,329,266 B1
(45) Date of Patent: Jun. 17, 2025

(54) SYSTEM FOR SUSTAINABLE AND REUSABLE COSMETIC CONTAINERS

(71) Applicant: Tiara Butler-Smith, Hyde Park, MA (US)

(72) Inventor: Tiara Butler-Smith, Hyde Park, MA (US)

( * ) Notice: Subject to any disclaimer, the term of this patent is extended or adjusted under 35 U.S.C. 154(b) by 0 days.

(21) Appl. No.: 18/936,897

(22) Filed: Nov. 4, 2024

Related U.S. Application Data

(63) Continuation-in-part of application No. 18/070,719, filed on Nov. 29, 2022.

(60) Provisional application No. 63/287,594, filed on Dec. 9, 2021.

(51) Int. Cl.
*A45D 40/00* (2006.01)
*A45D 40/02* (2006.01)

(52) U.S. Cl.
CPC .... *A45D 40/023* (2013.01); *A45D 2040/0031* (2013.01)

(58) Field of Classification Search
CPC ..... A45D 40/00; A45D 2040/0031; A45D 2040/0043
USPC ..... 248/346.11, 346.03, 346.04, 346.05, 248/346.06, 346.07; 206/385
See application file for complete search history.

(56) References Cited

U.S. PATENT DOCUMENTS

| | | | | |
|---|---|---|---|---|
| 1,810,249 | A | 6/1931 | Koehler | |
| 2,610,732 | A | 9/1969 | Calhoun | |
| 4,109,836 | A * | 8/1978 | Falarde | B65D 47/2031 239/533.13 |
| 4,169,547 | A | 10/1979 | Newell | |
| 4,621,935 | A | 11/1986 | Sussman | |
| 5,833,382 | A | 11/1998 | Jenks et al. | |
| 6,821,041 | B1 | 11/2004 | Hallam et al. | |
| 9,591,908 | B2 | 3/2017 | Kim et al. | |
| 9,809,052 | B2 | 11/2017 | Heipp | |
| 10,172,432 | B2 | 1/2019 | Paquet | |
| 2005/0035150 | A1 | 2/2005 | Laverdure | |
| 2009/0110786 | A1 | 4/2009 | Wells | |
| 2010/0078344 | A1 * | 4/2010 | Martins | A45D 40/06 206/385 |
| 2012/0199592 | A1 | 8/2012 | Hernandez et al. | |
| 2014/0131394 | A1 | 5/2014 | Wheeler | |

FOREIGN PATENT DOCUMENTS

KR 101803661 B1 11/2017

* cited by examiner

*Primary Examiner* — Andrew D Perreault
(74) *Attorney, Agent, or Firm* — Bold IP, PLLC; Houda El-Jarrah

(57) ABSTRACT

A reusable cosmetic carrying case and applicator having a pinch cap having a first flap and a second flap, a shaft body having a top portion configured to couple to a bottom portion of the pinch cap. The shaft body has an interior cavity and a removable, exchangeable cosmetic insert configured to fit within the interior cavity. Also, there is a base coupled to a bottom of the shaft body. The pinch cap can be lowered to reveal the cosmetic insert while a user simultaneously pushes up on an underside of the push cap within an interior of the cosmetic insert in order to cause the cosmetic insert to be accessible for use. Once the cosmetic insert is used up, another cosmetic insert can be inserted and used in the same carrying case and applicator.

10 Claims, 7 Drawing Sheets

SYSTEM FOR SUSTAINABLE AND REUSABLE COSMETIC CONTAINERS

CROSS-REFERENCE TO RELATED APPLICATIONS

This application is a continuation-in-part application which claims priority to U.S. non-provisional patent application Ser. No. 18/070,719, which was filed on Nov. 29, 2022, which claimed priority to U.S. provisional patent Application No. 63/287,594 which was filed on Dec. 9, 2021, all of which are incorporated by reference in its entirety.

FIELD OF THE DISCLOSURE

The present invention relates to a reusable lip cosmetic carrying device and applicator with replenishable and replaceable lip cosmetic inserts. The reusable lip cosmetic carrying case is a better product for the environment and allows the user to change out the lip cosmetics by replacing the reusable lip cosmetic inserts as often as desired. The reusable cosmetic container may also be used to house various other types of cosmetics, beauty, or hygiene related products, including, but not limited to, deodorants, solid foundations, body butters, soaps, or any other type of cosmetic or beauty or hygiene related product. The reusable cosmetic carrying case herein may be useful for any type of product, including, but not limited to, lip related cosmetics.

BACKGROUND

The cosmetic industry has used single use containers for decades and decades for a variety of cosmetics, in particular, for deodorants, eye shadows, lipsticks, lip balms, and lip related cosmetics or any type of cosmetic product. The beauty and cosmetic industry have relied on this unethical and unsustainable model of single use and usually non-recyclable plastic for everything, which has contributed to significant and long-lasting environmental damage and global warming. Consumers these days are becoming much more environmentally conscious and aware of the long-lasting damage that single use plastic products have on the environment, and before making a purchase, consumers are more frequently checking to see whether the product that they purchase is considered environmentally friendly or not.

Accordingly, it would be desirable to have a new type of container in which the container can be reused multiple times to house replaceable, biodegradable inserts that can be replaced as needed by a user.

SUMMARY

The present description includes one or more non-limiting embodiments for a reusable cosmetic carrying case comprising a pinch cap having a first flap and a second flap. The carrying case may further comprise a shaft body having a top portion configured to couple to a bottom portion of the pinch cap, whereby the shaft body further comprises a first interior cavity accessible from a top surface of the shaft body and further wherein the shaft body has a second interior cavity accessible from an underside interior portion of the shaft body. The carrying case may further include a cosmetic insert configured to fit within the interior cavity and a base, wherein the base is coupled to a bottom of the shaft body. The carrying case may further comprise a separate push cap having a raised portion coupled to a brim that fits within the second interior cavity of the shaft body that is accessible from an underside interior portion of the shaft body. The cosmetic insert is removable and replaceable from within the interior cavity of the shaft body of the reusable cosmetic carrying case.

In a non-limiting embodiment, the reusable carrying case may comprise a pinch cap that can be lowered or raised around the shaft body to provide access to the cosmetic insert. The carrying case may further include a circular ring coupled to a bottom portion of the pinch cap. There may be a finger tab that is integrated on an outside of the circular ring, whereby the finger tab is configured to facilitate lowering or raising of the pinch cap.

In a non-limiting embodiment, the first flap and the second flap of the pinch cap are configured to be pulled apart and lowered to a lower most position on the shaft body in order to expose a top of the lip cosmetic insert. The first flap and the second flap of the pinch cap are configured to open such that the first flap and the second flap are separated and further wherein the first flap and the second flap of the pinch cap are configured to close such that the first flap and the second flap are closed and come together over the interior cavity of the shaft body. Further, the carrying case may comprise a push cap that pushes the cosmetic insert through and out of the first interior cavity of the shaft body. The cosmetic insert may comprise any type of cosmetic and/or makeup or deodorant.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description is drawn to an innovative reusable cosmetic container and applicator that can house various types of cosmetic inserts. In a non-limiting embodiment, the reusable cosmetic container may be particularly suited for housing changeable cosmetic inserts, which include, but are not limited to, any type of cosmetic related insert, such as, without limitation thereto, deodorants, shampoo, conditioners, lipstick inserts, lip balms, lip products, eyeshadows, makeup, sunscreen, and/or perfumes. In a non-limiting embodiment, the reusable cosmetic container may have a pinch cap that sits on a shaft, whereby the shaft houses a removable cosmetic insert. Further details are provided in association with the Figures below.

Figure 1:
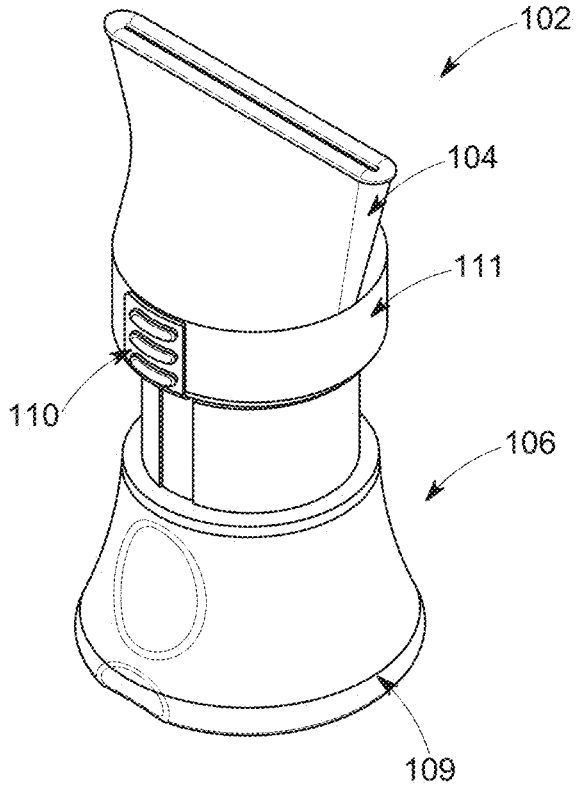
FIG. 1 depicts a pictorial illustration of a reusable cosmetic carrying case.

FIG. 1 shows an exemplary reusable cosmetic carrying case 102 according to a non-limiting embodiment. It is noted that the cosmetic carrying case 102 is also an applicator in that the user 502 can hold the cosmetic carrying case 102 and apply the cosmetic insert (e.g., cosmetic insert 202 shown in FIG. 2, FIG. 6, and in FIG. 8) to any part of a user 502 as needed depending on the type of cosmetic insert 202.

The reusable cosmetic carrying case 102, in a non-limiting embodiment, may include a pinch cap 104 that covers the shaft body 106. The shaft body 106 is configured to hold replaceable, removable cosmetic inserts 202 as shown, for example in FIG. 2.

The cosmetic inserts 202 may be a solid insert. The solid cosmetic insert 202 may be generally cylindrical shaped as shown for example in FIG. 2, FIG. 6, and FIG. 8. The solid cosmetic insert 202 may be shorter in height as well or may be longer and thinner as needed. The solid cosmetic insert 202 is intended to be removable and replaceable as desired by the user 502 of the reusable cosmetic carrying case 102. In a non-limiting embodiment, the cosmetic insert 202 may be a single piece or member that can be inserted and taken out of the first interior cavity 220 of the shaft body 106 of the carrying case 102 as a whole single piece.

The cosmetic insert 202 can be a lip related cosmetic insert, including lipstick, lip balms, or any other similar lip cosmetic. The cosmetic insert 202 may be a deodorant. The cosmetic insert 202 may be for perfume. The cosmetic insert 202 may be for shampoo, conditioner, or other hair related products. The cosmetic insert 202 may be for any type of makeup type product including eye shadows, blushes, highlighters, concealer, or any type of makeup without limitation. Advantageously, if a cosmetic insert 202 is used up or nearly used up, the user 502 can order and replace the cosmetic insert 202 with the same type of product or another type of cosmetic insert 202 that fits into the body shaft 106 of the reusable cosmetic carrying case 102. For example, if the user 502 uses up a lip type cosmetic insert 202, the user 502 only has to remove the used up cosmetic insert 202 and then can choose to replace the used product 202 with either the same lipstick type cosmetic insert 202 or another type of cosmetic insert 202 (e.g., that may be a perfume, shampoo, or any type of replacement cosmetic insert 202) as needed. Thus, the user 502 does not have to throw out the entire carrying case 102 and produce more excess, single use waste in the environment. Rather, the user 502 only needs to throw away the cosmetic insert 102 and thus help minimize environmental waste. As a further means to assist the environment, the cosmetic insert 102 may be biodegradable.

As shown in FIG. 1, the pinch cap 104 may be coupled to a top ring 111 encircling the lower end or just beneath the lower end of the pinch cap 104. The top ring 111 may further include a finger tab 110 having one or more grips that helps a user 502 when lowering the pinch cap 104 to expose the cosmetic insert 202 contained inside of the shaft body 106 and located within the pinch cap 104. The shaft body 106 may be generally cylindrical in shape in a non-limiting embodiment. Further, the shaft body 106 may be coupled to a bottom ring 109 as shown in FIG. 1 and in FIG. 2.

Figure 2:
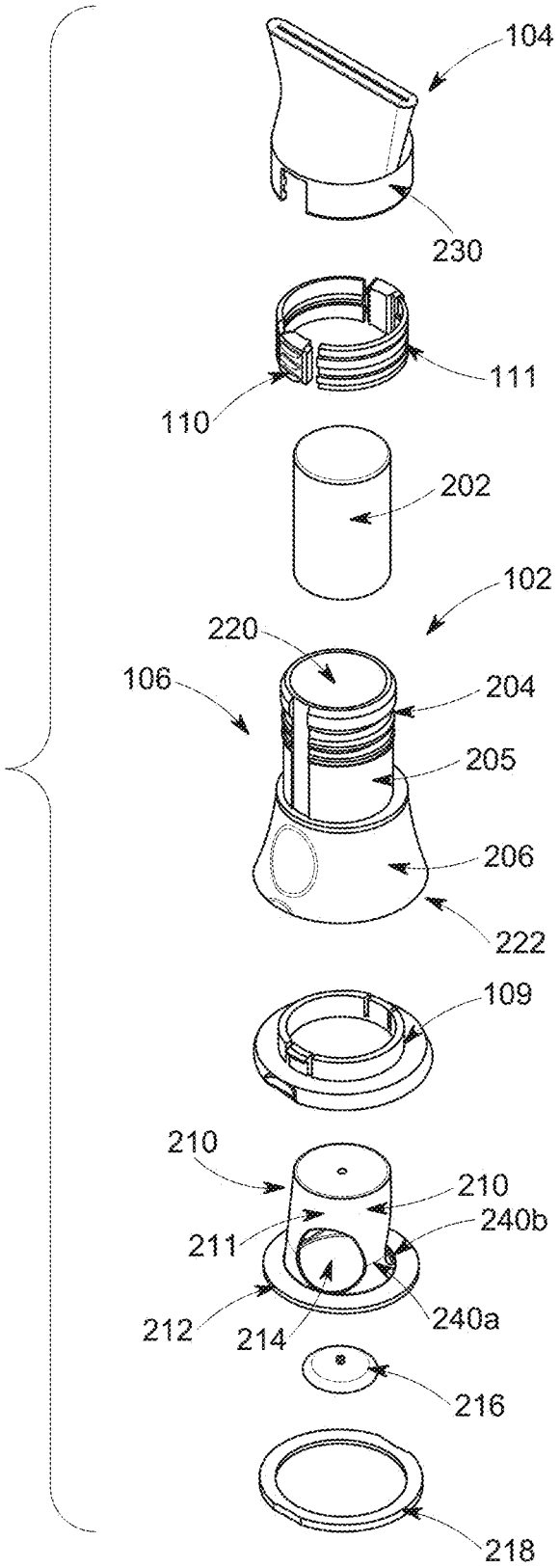
FIG. 2 depicts an exploded view of the reusable cosmetic carrying case shown in FIG. 1.

FIG. 2 shows an exploded view of the reusable cosmetic carrying case 102 and its exemplary components. As shown in FIG. 2, in a non-limiting embodiment, the reusable cosmetic carrying case 102 may include a pinch cap 104 coupled to the top ring 111. The top ring 111 may threadably engage with a bottom ring 230 that is integrated with the pinch cap 104 in a non-limiting embodiment. Further, the top ring 111 may threadably engage with the threads 204 distributed on an upper portion of the shaft body 106. The pinch cap 104 fits onto the top ring 111 which couples to the top threads 204 of the shaft body 106. In a non-limiting embodiment, the top ring 111 may snap into an underside of the bottom ring 230 of the pinch cap 104.

In a non-limiting embodiment, the shaft body 106 may comprise an upper portion 205 that is generally a vertical, cylinder that is coupled to a bottom portion 206 that expands outwardly away from the cylindrical upper portion 205. The bottom portion 206 may protrude outwardly away from the vertical upper portion 205 in a non-limiting embodiment. It is noted that in other non-limiting embodiments, the bottom portion 206 may be in alignment with the upper portion 205 and may have a same general shape/form. Notably, the ring 111 may have a wider width in comparison with the top portion 205 of the shaft body 106.

Figure 4:
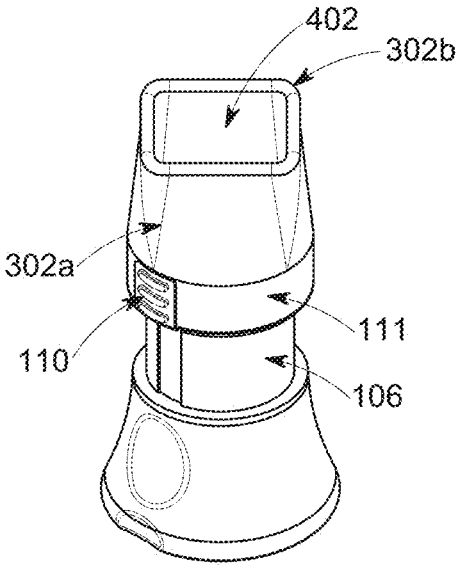
FIG. 4 depicts a pictorial illustration of an open lid for the reusable cosmetic carrying case.
Figure 5:
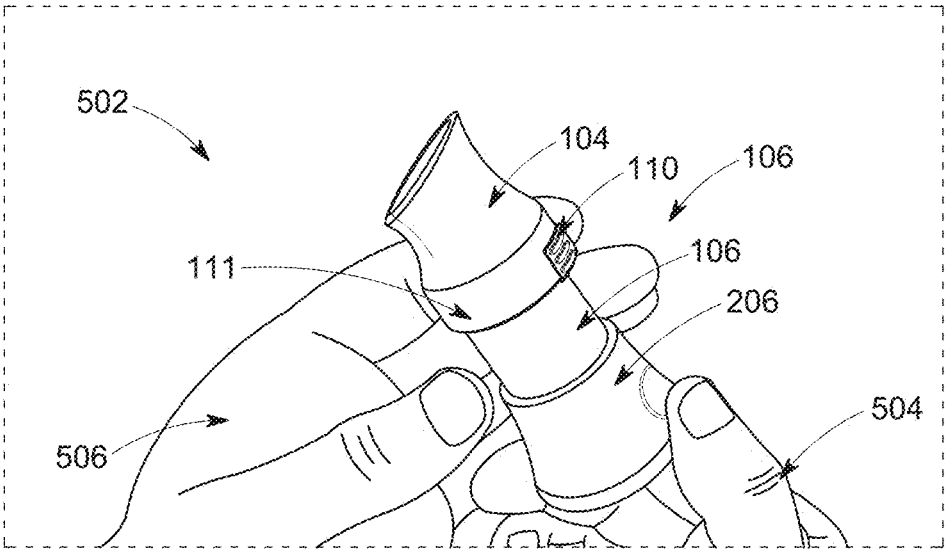
FIG. 5 depicts a pictorial illustration of a user holding the reusable cosmetic carrying case.

The shaft body 106 includes a first interior cavity or hole 220 contained or defined by the interior side walls of the shaft body 106. The first interior cavity 220 is visible through the interior opening 402 (e.g. as shown in FIG. 4) of the pinch cap 104 when the flaps 302*a*, 302*b* of the pinch cap 104 are pulled apart or open.

In a non-limiting embodiment, the pinch cap 104 is meant to be placed over a top of the shaft 106 and can remain on the shaft 106 even when the user 502 is applying the cosmetic insert 202 located inside the first interior cavity 220 of the shaft body 106 on an applicably body part of the user 502 depending on the type of cosmetic insert 202. Accordingly, the carrying case 102 also acts as an applicator that the user 502 can hold (e.g. as shown in FIGS. 5-8). As shown in FIG. 2, in the exemplary exploded view, a bottom ring 109 may fit inside of the underside of the shaft body 106. It is noted that the term "interior cavity" as used herein may interchangeably be used with the term "hole" or "bore."

Figure 7:
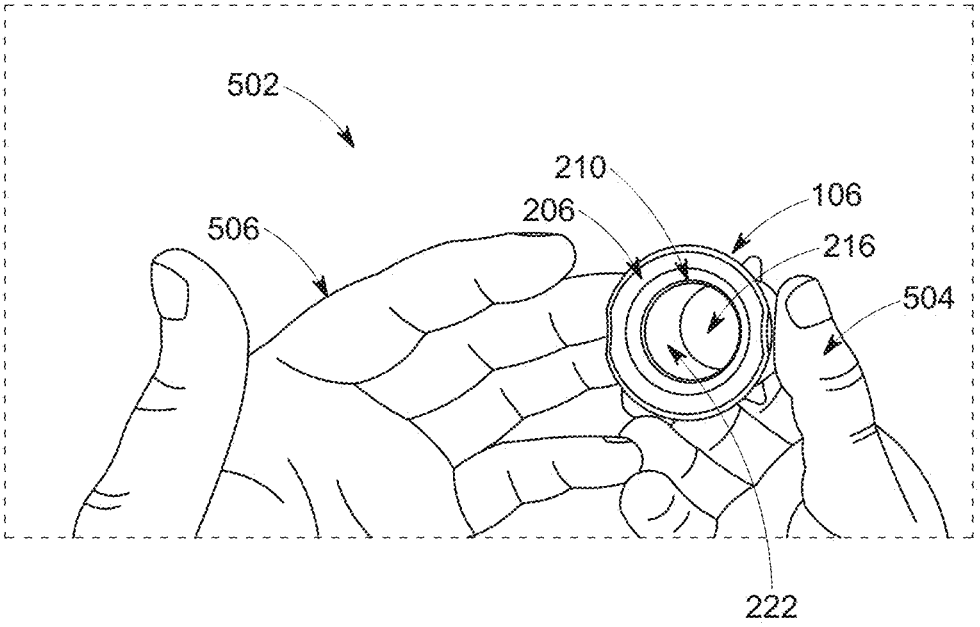
FIG. 7 depicts a pictorial illustration of an exemplary underside of the reusable cosmetic carrying case.

Further, as shown in FIG. 2, a separate push cap 210 may couple to the bottom ring 109. The push cap 210 may comprise a top raised portion 211 that is integrally formed with a bottom rim 212. The push cap 210 plays an important role in that the user 502 can push up on the cosmetic insert 202 by placing the user 502's finger through the interior cavity 214 contained within an interior underside, as shown in FIG. 7, of the raised portion 211 of the push cap 210 which in turn pushes up on the cosmetic insert 202 that is held inside of the first interior cavity 220 of the shaft body 106. In a non-limiting embodiment, the push piece 216 fits within the interior cavity 220 and pushes against or contacts the push cap 210 and the user 502's finger pushes up on the push cap 210 to push the cosmetic product 202 up and out of the first interior cavity 220. When the user 502 keeps pressure applied via a user 502's finger on the interior underside surface 702 of the raised portion 211 of the push cap 210, the cosmetic insert 202 stays raised above the top edges of the flaps 302*a*,302*b* of the push cap 210 such that the user 502 can bring the cosmetic carrying case 102 towards the specific body part where the user 502 intends to apply an amount of the cosmetic insert 202. In a non-limiting embodiment, when the user 502's finger is removed and pressure released from the underside of push cap 210 and/or push piece 216, the cosmetic product 202 automatically or naturally falls down and back into the first interior cavity 220. In other non-limiting embodiments, the cosmetic product 202 can be gradually raised in increments in an upward direction out of the first interior cavity 220 and can also gradually be lowered in increments down back into the first interior cavity 220.

In a non-limiting embodiment, the push cap 210 may further comprise one or more side holes 240*a*, 240*b*, as shown for example in FIG. 2, which help to cause the sides of the raised portion 211 of the push cap 210 to deflect inwards when the user 502 502 inserts his or her finger inside of the hollow cavity 214 of the push cap 210 in order to push up on the cosmetic insert 202.

In a further non-limiting embodiment, the carrying case 102 may further include a push piece 216 that further fits within an interior cavity 214 of the push cap 210. When a user 502 applies pressure to the push piece 216, in a non-limiting embodiment, the push piece 216 may further cause the inserted cosmetic insert 202 to raise up and out of the designated first interior cavity 220 where the cosmetic insert 202 is held in its retracted position.

As shown in the exploded view in FIG. 2, there may also be an additional base ring 218 that further fits to an underside of the bottom ring 109.

Figure 3:
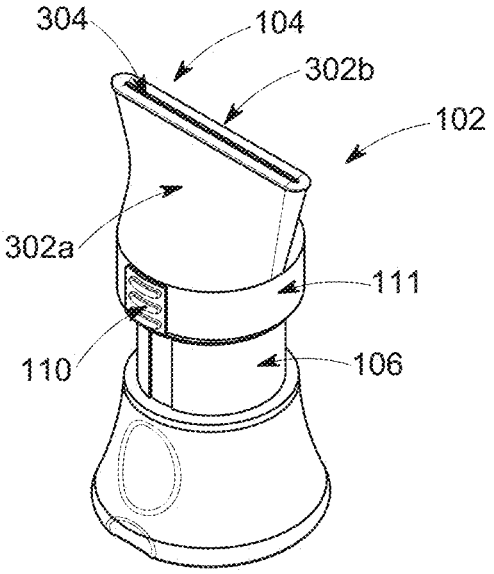
FIG. 3 depicts a pictorial illustration of a closed lid for the reusable cosmetic carrying case.

FIG. 3 features a perspective view of the carrying case 102 and the pinch cap 104. In a non-limiting embodiment, the pinch cap 104 can be in a closed position as shown in FIG. 3, and is also configured to be open, as shown in FIG. 4 to expose the interior opening 402 that leads to the first interior cavity 220 of the shaft body 106 where the cosmetic insert 202 is housed. Advantageously, the pinch cap 104 is configured to stay on the shaft body 106 when the cosmetic insert 202 is in its closed position, as shown in FIG. 3, or in its open, exposed position as shown in FIG. 4 and also in FIG. 6. The user 502 may choose to access the finger tab 110 on the top ring 111 to pull the pinch cap 104 down and/or access the finger tab 110 to raise the pinch cap 104 upwards again. Advantageously, the pinch cap 104 can slide up and down along the narrower shaft body 106.

The pinch cap 104 may include a first flap 302*a* and a second flap 302*b* that form a closed contact joint 304 as shown in FIG. 3. The flaps 302*a*, 302*b* may close towards each other as shown in FIG. 3 and pull apart to stay open without assistance as shown in FIG. 4. In a non-limiting embodiment, the first flap 302*a* and the second flap 302*b* snap towards and away from each other.

FIGS. 5-8 further clarify the method of use and functions of the various exemplary components of the carrying case 102 according to one or more non-limiting embodiment. Ass shown in FIG. 5, a user 502 may prefer to hold the carrying case 102 with both hands. A user 502 may hold the carrying case 102 via the bottom portion 206 of the shaft body 106 with one hand 504 leaving the other free hand 506 for manipulating a position of the pinch cap 104. The user 502 may choose to first open the pinch cap 104 by pressing down on the outer surfaces of the first flap 302*a* and the second flap 302*b* and/or pulling the first flap 302*a* and the second flap 302*b* apart from the joint 304. After opening the flaps 302*a* and 302*b*, the user 502 may press on the finger tab portion 110 of the top ring 111 encircling the bottom portion of the pinch cap 104 and/or coupled to the pinch cap 104 in order to lower the finger tab 110.

Figure 6:
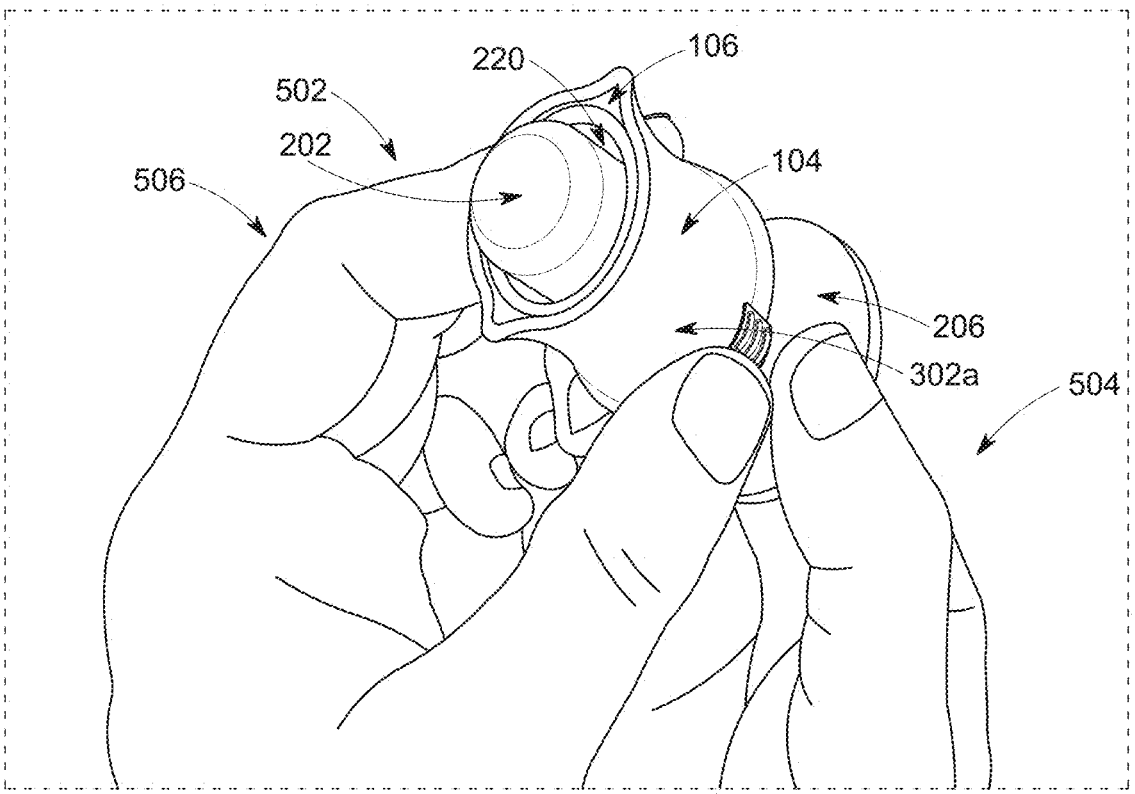
FIG. 6 depicts a pictorial illustration of a user lowering a cap of the reusable cosmetic carrying case.

FIG. 6 shows that the pinch cap 104 has been lowered with the side flaps 302*a*, 302*b* pushed apart such that the pinch cap 104 is in an open position. The user 502 may insert a finger from one hand 504 inside of the hollow interior cavity 214 of the push cap 210 from an underside of the shaft body 106. FIG. 7 provides a view of the hollow interior cavity 214 of the push cap 210 inserted into an underside or the second interior cavity 222 of the carrying case 102.

With respect to FIG. 6, the user 502 may insert one or more fingers inside of the hollow cavity 214 of the push cap 210 and cause the cosmetic insert 202 to raise upwards to provide further access to the cosmetic insert 202. It is noted than when the user 502 stops or ceases to push up with their finger on the underside surface 702 of the push cap 210 and pulls his or her finger out from the hollow interior cavity 214 of the push cap 210 and by pulling the user 502's finger away from the push piece 216, the cosmetic insert 202 will naturally descend or retract back into the first interior cavity 220 of the shaft body 106. The user 502 may then push up on the finger tab 110 of the top ring 111 to cause the pinch cap 104 to slidably raise upwards again above the cosmetic insert 202. The user 502 may then push on each flap 302*a*, 302*b* to cause them to be in the closed position as shown in FIG. 1, FIG. 2, and FIG. 3. The pinch cap 104, thus, closes around the interior opening 402 of the pinch cap 104 thereby preventing from any debris from falling into the first interior cavity 220 of the shaft body 106 or any unwanted damage from occurring to the cosmetic insert 202.

Figure 8:
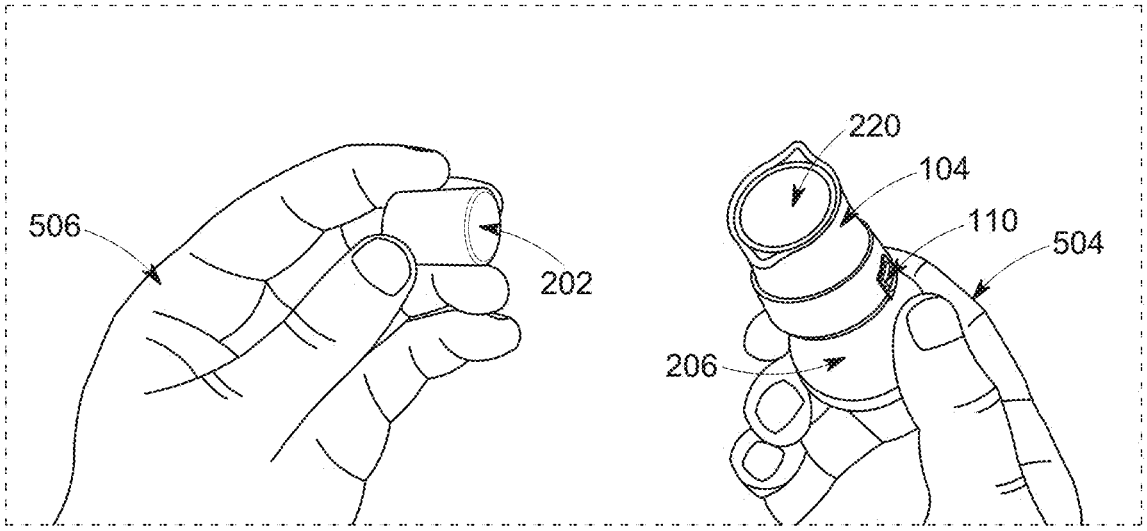
FIG. 8 depicts a pictorial illustration of a user removing a cosmetic or hygiene product insert in the reusable carrying case.

The pinch cap 104 may be slidably lowered to rest around the top portion 205 of the shaft body 106 as shown in FIG. 8. The user 502 may remove the cosmetic insert 202 in its entirety as a whole piece from the first interior cavity 220 of the shaft body 106 as shown in FIG. 8. Thus, the user 502 may replace the cosmetic insert 202 with a replacement cosmetic insert 202.

The user 502 has the option to change out the cosmetic inserts 202 as desired if a user 502 wants a different color or brand or texture. Multiple decorative elements may be included on an outside of the reusable cosmetic carrying case 102, including, any colors, patterns, text, prints, or any other type of decorative elements. A manufacturer or seller or distributor may provide a myriad of different cosmetic insert 202 that may be usable with the cosmetic carrying case 102.

The reusable cosmetic carrying case 102 may be sized to suit each product (e.g. cosmetic insert 202) and the user 502 may apply the contained product to the designated area or respective area of the user 502's body. For example, upon lowing the pinch cap 104 and exposing the cosmetic insert 202 (e.g. as shown in FIG. 6), the user 502 may raise the entire carrying case 102 towards a part of the user 502's body, such as the user 502's lips, eyes, cheeks, head or hair, underarms, or any other part as needed.

Beneficially, the reusable cosmetic carrying case 102 will reduce the waste associated with single use carrying cases for cosmetics that are only intended to be used once and then thrown away, which contributes to the environmental pollution and all the associated environmental damage that occurs to the earth. The single use containers that are currently being used are unsustainable and unethical and are not reusable, unlike the reusable cosmetic carrying case 102 as described and shown herein. Many other advantages and benefits are offered by the one or more non-limiting embodiments of the reusable cosmetic carrying case 102 as described herein.

Specific details are given in the description to provide a thorough understanding of the embodiments. However, embodiments may be practiced without these specific details. This description provides example embodiments only and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, some embodiments are described as processes depicted as flow diagrams or block diagrams. Although each may describe the operations as a sequential process, many of the operations can be performed in parallel or concurrently. In addition, the order of the operations may be rearranged. A process may have additional steps not included in the figure.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus, comprising:

a reusable cosmetic carrying case, comprising:

a pinch cap having a first flap and a second flap;

a shaft body having a top portion configured to couple to a bottom portion of the pinch cap, wherein the shaft body further comprises a first interior cavity accessible from a top surface of the shaft body and further wherein the shaft body has a second interior cavity accessible from an underside interior portion of the shaft body, wherein the pinch cap is connected to the shaft body, and wherein the pinch cap is configured to be slidably raised to a closed position to cover the first interior cavity or to be lowered to an open position to expose the first interior cavity, wherein the pinch cap is configured to slide down along the shaft body and rest in the open position while remaining attached to the shaft body of the reusable cosmetic carrying case when in the open position;

a cosmetic insert configured to fit within the first interior cavity of the shaft body, wherein the cosmetic insert is a type of solid cosmetic product, wherein the cosmetic insert is individually removable from the first interior cavity as a whole piece;

a separate push cap that is inserted and fits within the second interior cavity of the shaft body that is accessible from an underside interior portion of the shaft body, wherein pushing up onto the separate push cap causes the cosmetic insert to raise up out of the first interior cavity, and releasing the separate push cap causes the cosmetic insert to naturally fall back down into the first interior cavity of the shaft body, wherein the cosmetic insert is removable and replaceable with another cosmetic insert from within the first interior cavity of the shaft body of the reusable cosmetic carrying case.

2. The apparatus of claim 1, wherein lowering the pinch cap to the open position exposes the cosmetic insert and raising the pinch cap to the closed position covers the cosmetic insert.

3. The apparatus of claim 1, wherein a circular ring is coupled to the bottom portion of the pinch cap.

4. The apparatus of claim 3, wherein a finger tab is integrated on an outside of the circular ring, wherein the finger tab is configured to facilitate the lowering or raising of the pinch cap.

5. The apparatus of claim 1, wherein the separate push cap comprises a raised portion coupled to a brim.

6. The apparatus of claim 1, wherein the first flap and the second flap of the pinch cap are configured to open such that the first flap and the second flap are separated and further wherein the first flap and the second flap of the pinch cap are configured to close such that the first flap and the second flap are closed and come together over the first interior cavity of the shaft body.

7. The apparatus of claim 1, wherein the push cap pushes the cosmetic insert through and out of the first interior cavity of the shaft body.

8. The apparatus of claim 1, wherein the cosmetic insert is an insert for any type of cosmetic or makeup.

9. The apparatus of claim 1, wherein the cosmetic insert is an insert for a deodorant.

10. The apparatus of claim 1, wherein the cosmetic insert is an insert for shampoo or conditioner in solid form.

* * * * *